US006602079B2

(12) United States Patent
Chiriku et al.

(10) Patent No.: US 6,602,079 B2
(45) Date of Patent: Aug. 5, 2003

(54) JUNCTION BOX FOR VEHICLE

(75) Inventors: Akihiko Chiriku, Shizuoka-ken (JP); Norio Ito, Shizuoka-ken (JP); Hiroyuki Sasaki, Shizuoka-ken (JP); Hiroyuki Kondo, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/131,025

(22) Filed: Apr. 25, 2002

(65) Prior Publication Data

US 2002/0168882 A1 Nov. 14, 2002

(30) Foreign Application Priority Data

Apr. 27, 2001 (JP) ..... P 2001-133321

(51) Int. Cl.[7] ..... H01R 12/00
(52) U.S. Cl. ..... 439/76.2
(58) Field of Search ..... 439/76.2, 949, 439/65; 174/50, 58

(56) References Cited

U.S. PATENT DOCUMENTS 5,229,922 A * 7/1993 Muramatsu et al. ..... 361/736
5,295,842 A * 3/1994 Ozaki et al. ..... 439/76.2
5,478,244 A * 12/1995 Maue et al. ..... 439/76.2
5,703,757 A * 12/1997 Hayes et al. ..... 361/752
5,980,302 A * 11/1999 Saka ..... 439/404
6,008,982 A * 12/1999 Smith ..... 361/624
6,511,331 B2 * 1/2003 Saito et al. ..... 439/76.2
6,514,091 B2 * 2/2003 Saito et al. ..... 439/76.2
6,515,226 B2 * 2/2003 Chiriku et al. ..... 174/50
6,541,700 B2 * 4/2003 Chiriku et al. ..... 174/50

* cited by examiner

*Primary Examiner*—Tulsidas Patel
(74) *Attorney, Agent, or Firm*—Finnegan, Henderson, Farabow, Garrett & Dunner, L.L.P.

(57) ABSTRACT

A junction box which includes a casing and a junction box body. The junction box body includes a first board with a conducting member forming a circuit thereon; second and third boards mounted on the first board, each with a circuit formed thereon to be connected to the circuit of the first board; and a cover for housing them. The third board includes a substrate, a terminal block fitted on the substrate, and a conductor which is connected to the circuit of the third board and provided with a pressure terminal extending out of the terminal block. The pressure terminal penetrates through the first board to be connected by solderless connection to the conducting member of the first board.

11 Claims, 12 Drawing Sheets

JUNCTION BOX FOR VEHICLE

BACKGROUND OF THE INVENTION

1. Field of Invention

The present invention relates to a junction box to connect and distribute multiple wiring harnesses in a vehicle or the like 2. Description of Related Art In a conceivable junction box for a vehicle, a wiring plate in which single-layer or multi-layer wiring boards are stacked, and a control board fitted with electronic components such as electronic elements, resistors, coils, relays and fuses, are loaded parallel to each other and connected with respective terminals.

Since the control board is loaded parallel (so-called "flatways") to the wiring plate, large area over the wiring plate is occupied by a required space for fitting the control board thereon, and the wiring plate and the junction box is eventually enlarged.

Moreover, by the flatways connection, relay terminals or connectors are required to connect bus bar terminals extending out of mutually opposing faces thereof. The number of the relay terminals or the connectors is required to be equal to that of the bus bar terminals, whereby the number of components and assembling steps are increased.

SUMMARY OF THE INVENTION

The object of the present invention is to provide a junction box, which is compact and simply assembled, with a less space on a wiring plate for mounting a control board thereon and with fewer components for connecting the control board to the wiring plate.

A first aspect of the present invention is a junction box comprising: a casing; and a junction box body housed in the casing, wherein the junction box body comprises a first board having a conducting member to form a circuit thereon; second and third boards mounted on the first board, respectively including a circuit formed thereon to be connected to the circuit of the first board; and a cover for housing the first, second and third boards, wherein the third board includes a substrate, a terminal block fitted on the substrate; and a conductor connected to the circuit of the third board, and provided with a pressure terminal extending out of the terminal block, the pressure terminal for penetrating through the first board to be connected by solderless connection to the conducting member of the first board.

Preferably, the substrate of the third board is mounted substantially perpendicular to the first board, and the conducting member of the first board is arranged to form the circuit on a face opposite to a face thereof on which the second board is mounted.

And preferably, the second board includes a bus bar to form the circuit thereof, and the bus bar is provided with a pressure terminal for penetrating through the first board to be connected by solderless connection to the conducting member of the first board.

And preferably, the terminal block is configured with a face perpendicular to the substrate, and the pressure terminal of the conductor extends out of the face in a direction parallel to the substrate.

According to the first aspect of the present invention constituted as described above, upon mounting a control board (as the third board) onto a wiring plate (as the first board), connection between the control board and the circuit of the wiring plate is achieved simply by training an orthogonal face (as the face perpendicular to the substrate) of the terminal block to a face of the control board upon the wiring plate, by allowing the pressure terminal of a lead terminal (as the conductor) extending from the orthogonal face to penetrate through the wiring plate, and by solderless connection of the pressure terminal to an electric wire (as a conducting member) which is cabled on the opposite face of the wiring plate. Since the pressure terminal of the lead terminal extends out of the terminal block in a direction parallel to the substrate of control board, the control board is mounted perpendicularly on the wiring plate by solderless connection.

A second aspect of the present invention is the junction box according to the first aspect, in which the terminal block of the third board is divided in a longitudinal direction thereof into divided blocks, and adjacent end portions of the respective divided blocks are mutually superimposed to be fastened integrally to the first board.

According to the second aspect of the present invention constituted as described above, a superimposed portion of the end portion of the respective divided blocks are integrally fastened to the wiring plate. Therefore, the number of fasteners is reduced in comparison with a case of fitting both end portions of the terminal block severally onto the wiring plate, whereby assembling steps are reduced. Moreover, since adjacent terminal blocks can be integrated, the whole terminal blocks can be positioned accurately.

A third aspect of the present invention is the junction box according to the first aspect, in which the conductor penetrates the terminal block and the substrate, and has a bent portion exposed in a position between the terminal block and the substrate.

Preferably, an end portion of the conductor penetrating the substrate is soldered to the circuit of the third board.

According to the third aspect of the present invention constituted as described above, a direction of the pressure terminal can be orthogonal to a direction of the end portion of the lead terminal penetrating the substrate to be soldered onto the circuit of the control board, and it is possible to prevent load generated upon connecting, by solderless connection, the pressure terminal to the electric wire of the wiring plate to be directly transferred onto a soldered portion owing to flexure of the lead terminal.

BRIEF DESCRIPTION OF THE DRAWINGS

The invention will now be described with reference to the accompanying drawings wherein.

DETAILED DESCRIPTION OF THE PREFERRED EMBODIMENT

Figure 1:
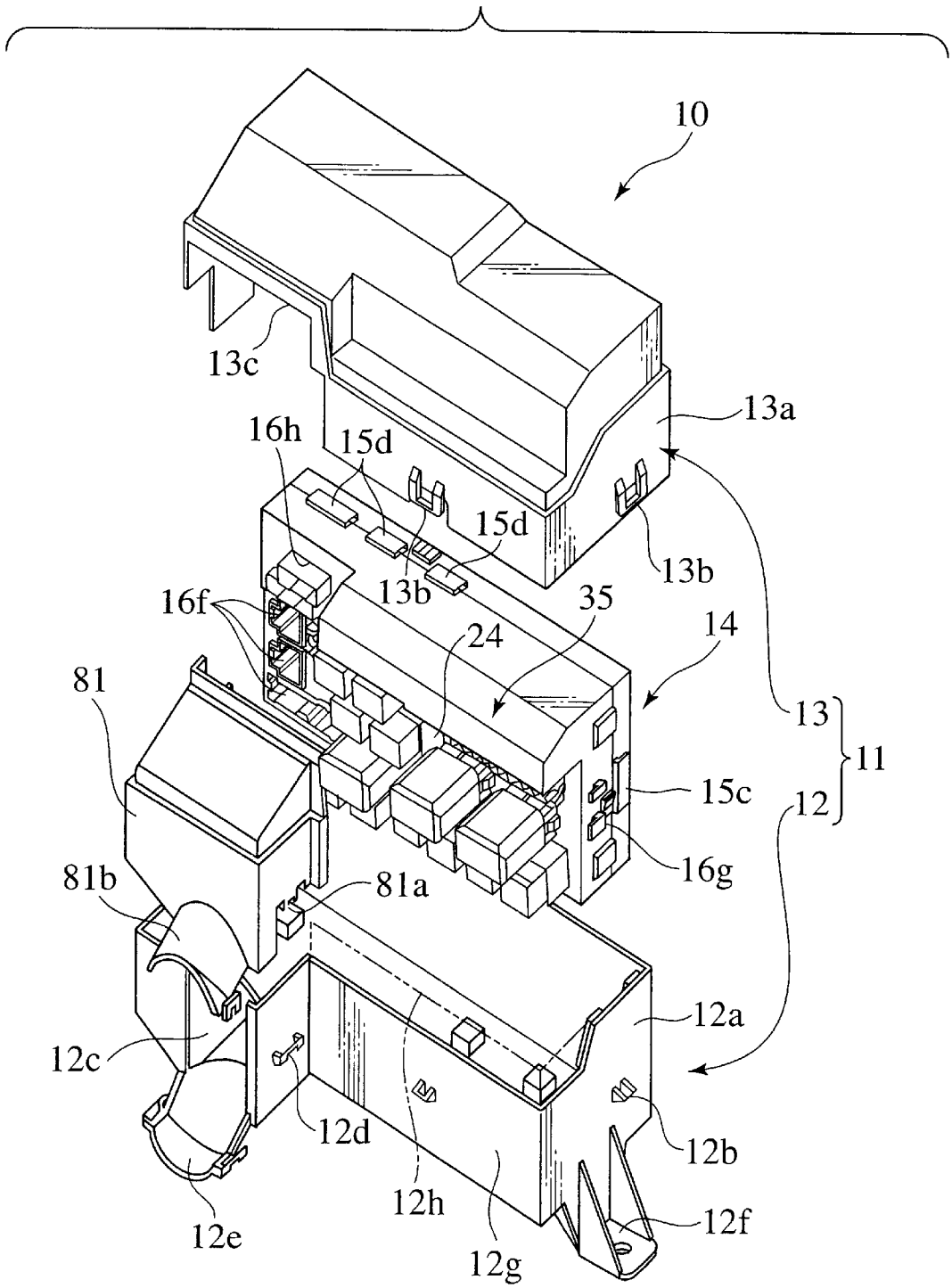
FIG. 1 is an exploded perspective view showing a junction box according to an embodiment of the present invention, which illustrates a casing and a junction box body collectively constituting the junction box.

An embodiment of the present invention will be explained below with reference to the drawings, wherein like members are designated by like reference characters.

As shown in FIG. 1, a junction box 10 of the embodiment includes a casing 11 composed of a lower case 12 and an upper case 13, and a junction box body 14. The junction box 10 is loaded inside an engine room of a vehicle or the like. The junction box body 14 is housed between the lower case 12 and the upper case 13.

Junction Box Body 14

Figure 2:
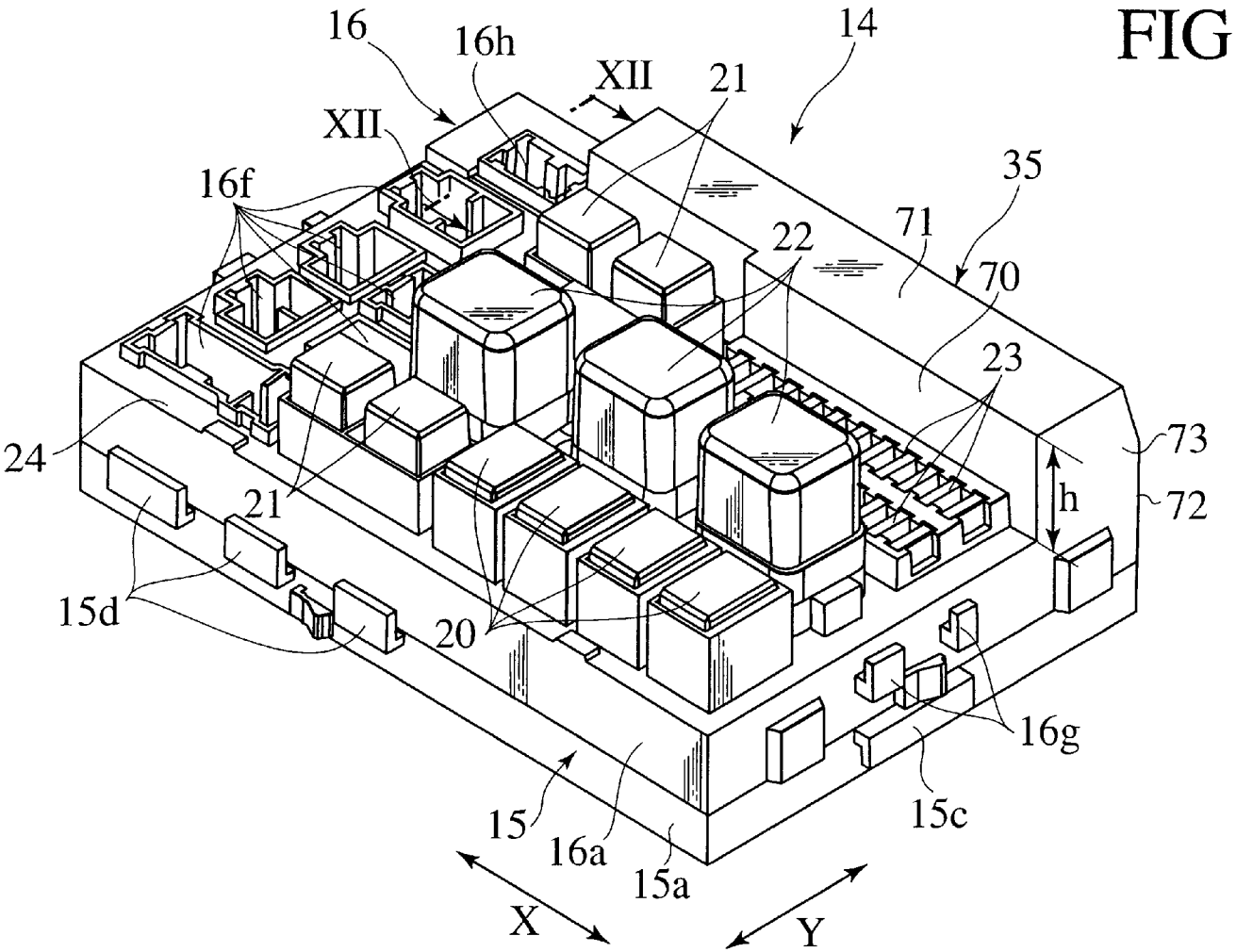
FIG. 2 is a perspective view showing the junction box body of the junction box according to the embodiment of the present invention.
Figure 3:
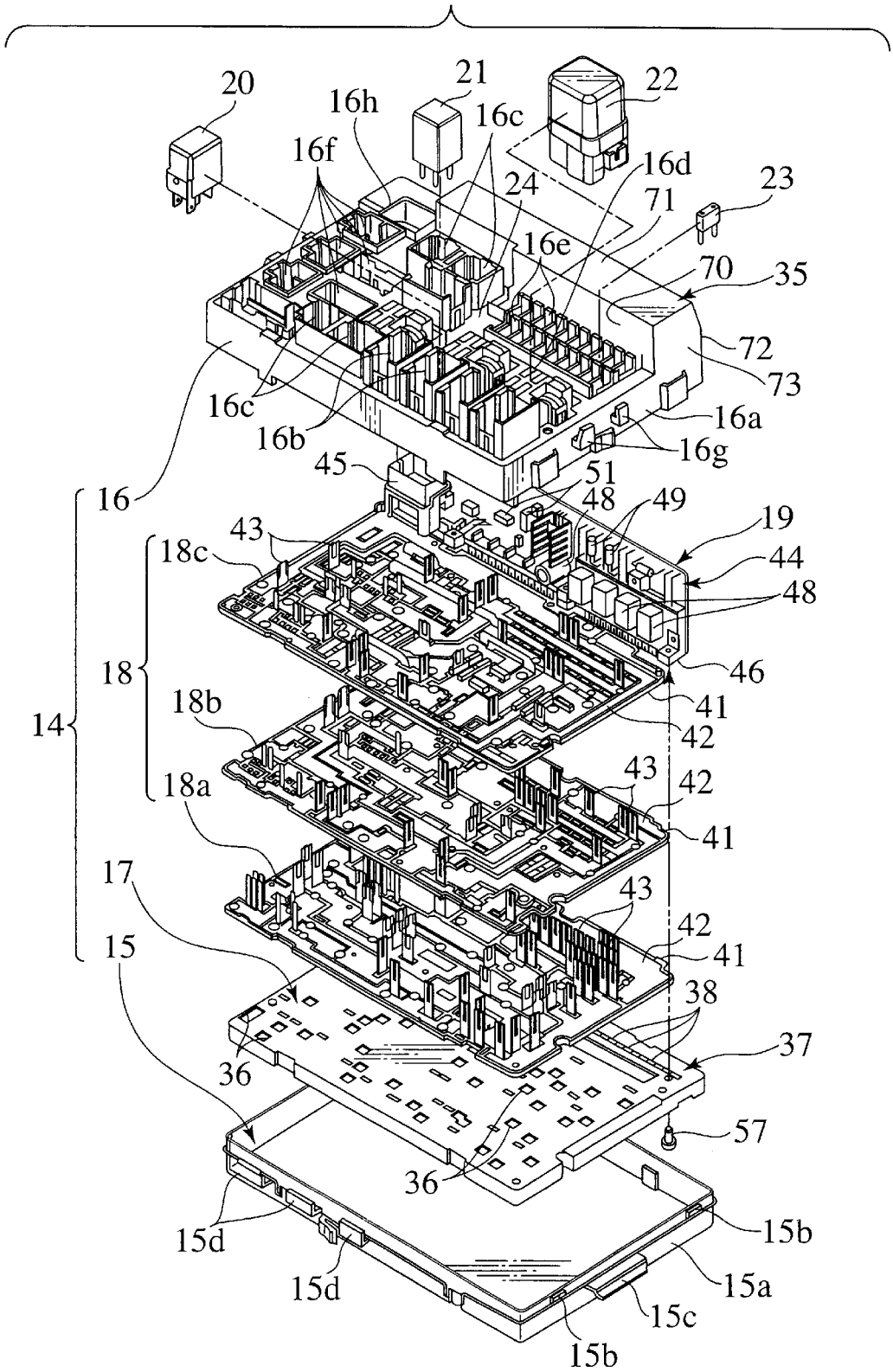
FIG. 3 is an exploded perspective view of the junction box body of the junction box according to the embodiment of the present invention, which illustrates a wiring board, a wiring plate, a control board and a cover collectively constituting the junction box body.

As shown in FIG. 2 and FIG. 3, the junction box body 14 includes an under cover 15, an upper cover 16, a wiring plate 17 (as a first board), wiring boards 18 (as second boards) stacked in multiple stages, and a control board 19 (as a third board) fixed to the wiring plate 17. The wiring plate 17, the wiring boards 18 and the control board 19 are housed between the under cover 15 and the upper cover 16. A sidewall 16*a* surrounding the upper cover 16 is detachably fitted into the under cover 15 via lock claws 15*b*, which are provided around an upper side periphery of a sidewall 15*a* surrounding the under cover 15.

Upper Cover 16

Figure 4:
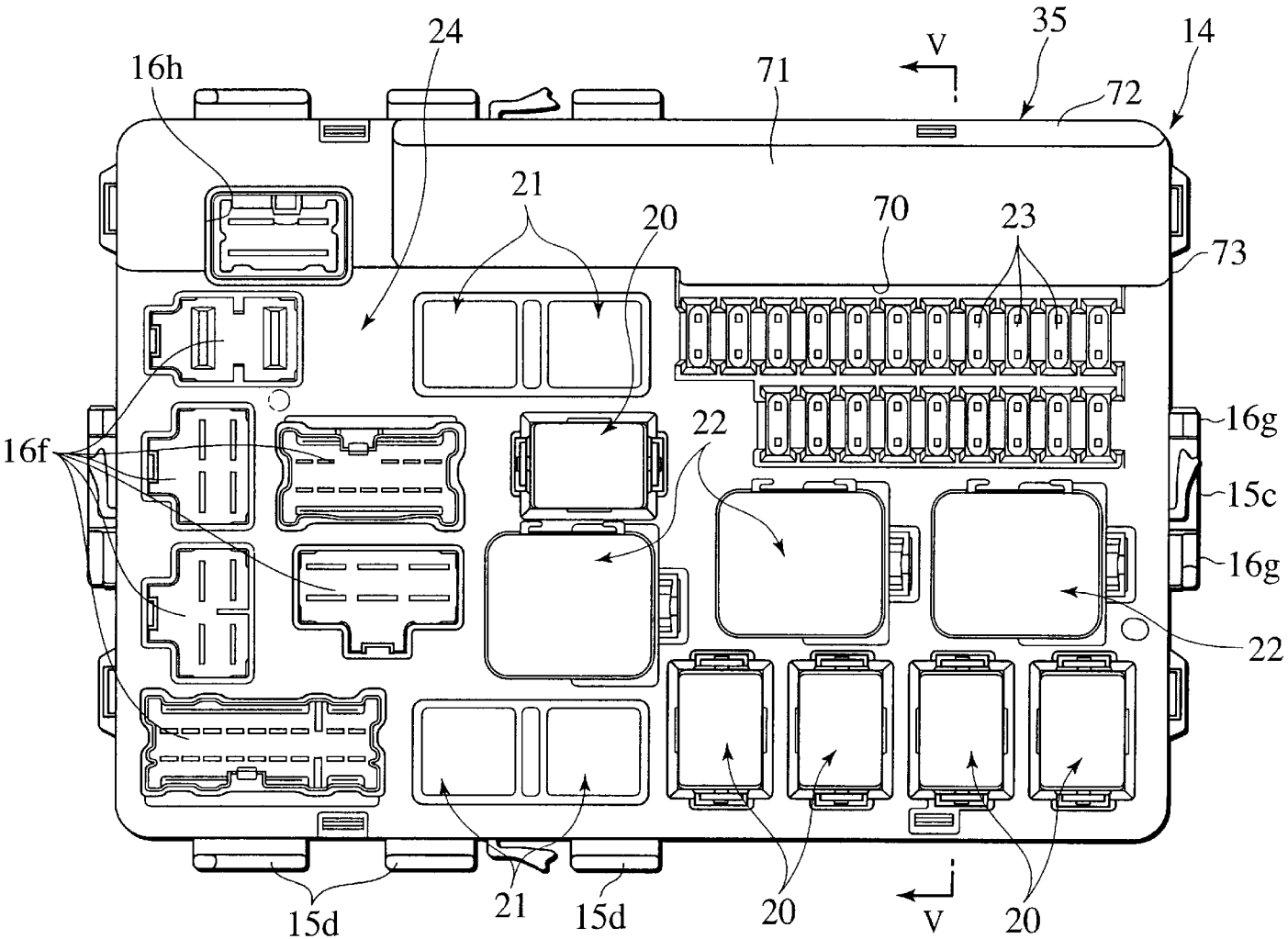
FIG. 4 is a plan view showing the junction box body.

As shown in FIGS. 2 to 4, the upper cover 16 constitutes a socket stage 24 for various external relays such as micro relays 20, half-micro relays 21 and 2M relays 22, and for external electronic components such as fuses 23. On the socket stage 24, provided are relay sockets 16*b*, 16*c* and 16*d* for various relays such as the micro relays 20, the half-micro relays 21 and the 2M relays 22, and a fuse socket 16*e* for the fuses 23, respectively.

Moreover, a plurality of connector slots 16*f* for detachably inserting opponent connectors (not shown) are provided on one side (a left portion in FIG. 4) of the upper cover 16. In addition, as shown in FIG. 2, first guide hooks 16*g* and 15*c* of L-shaped cross sections are provided integrally in a protruding manner on both sidewalls 15*a* and 16*a* stretching in the X direction of the upper cover 16 and the under cover 15, respectively. Similarly, second guide hooks 15*d* of L-shaped cross sections are provided integrally in a protruding manner on sidewall 15*a* stretching in the Y direction of the under cover 15 and perpendicular to the faces of the sidewall 15*a* stretching in the X direction of the under cover 15, where the first guide hooks 15*c* are provided. Moreover, an expanded portion 35 is provided on one side of the socket stage 24 for the electronic components, and the control board 19, which is fixed to the wiring plate 17, is housed inside the expanded portion 35.

Wiring Plate 17

Figure 5:
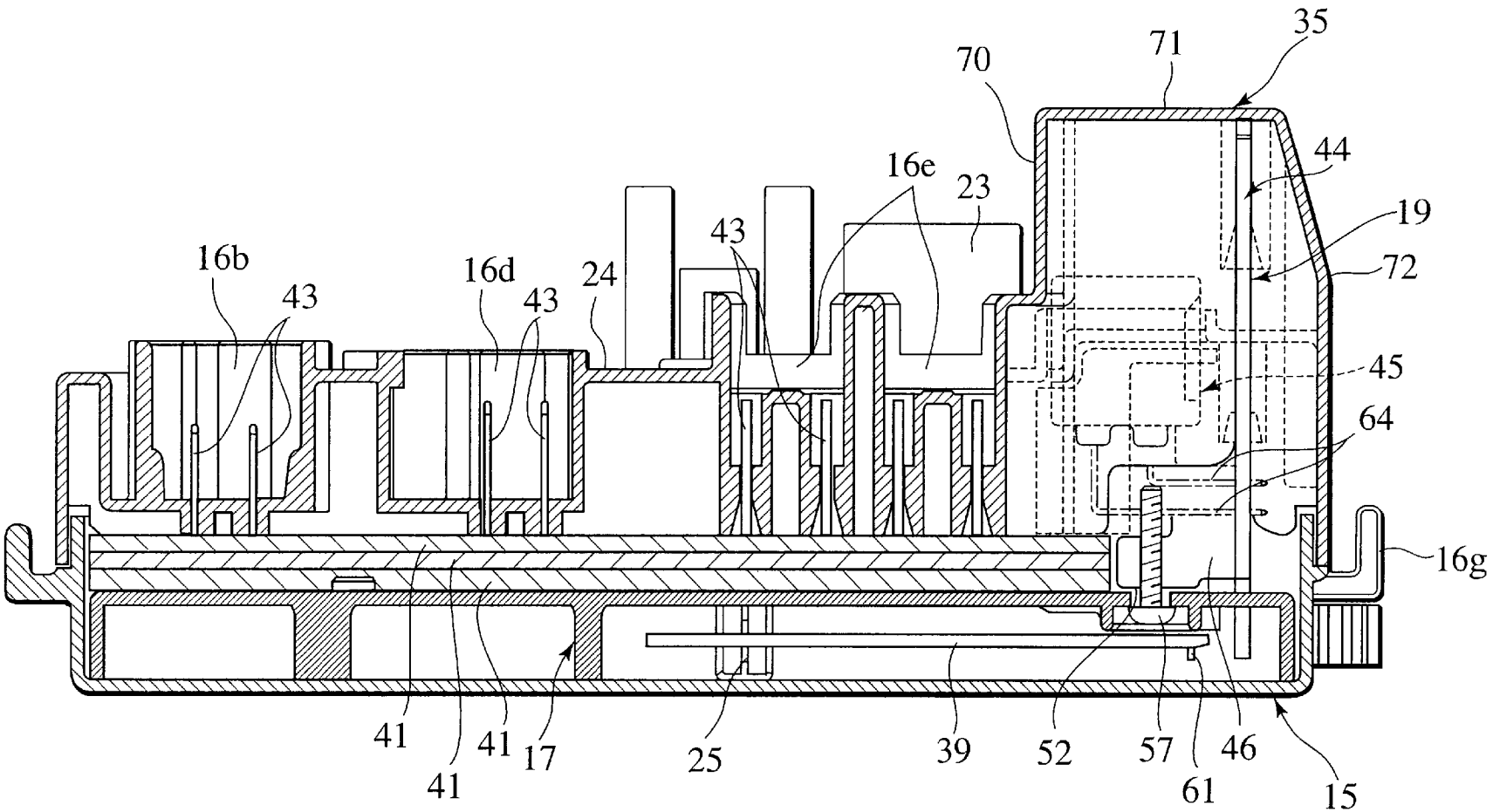
FIG. 5 is a cross-sectional view showing the inside of the junction box body, which is taken along the V—V line in FIG. 4.
Figure 6:
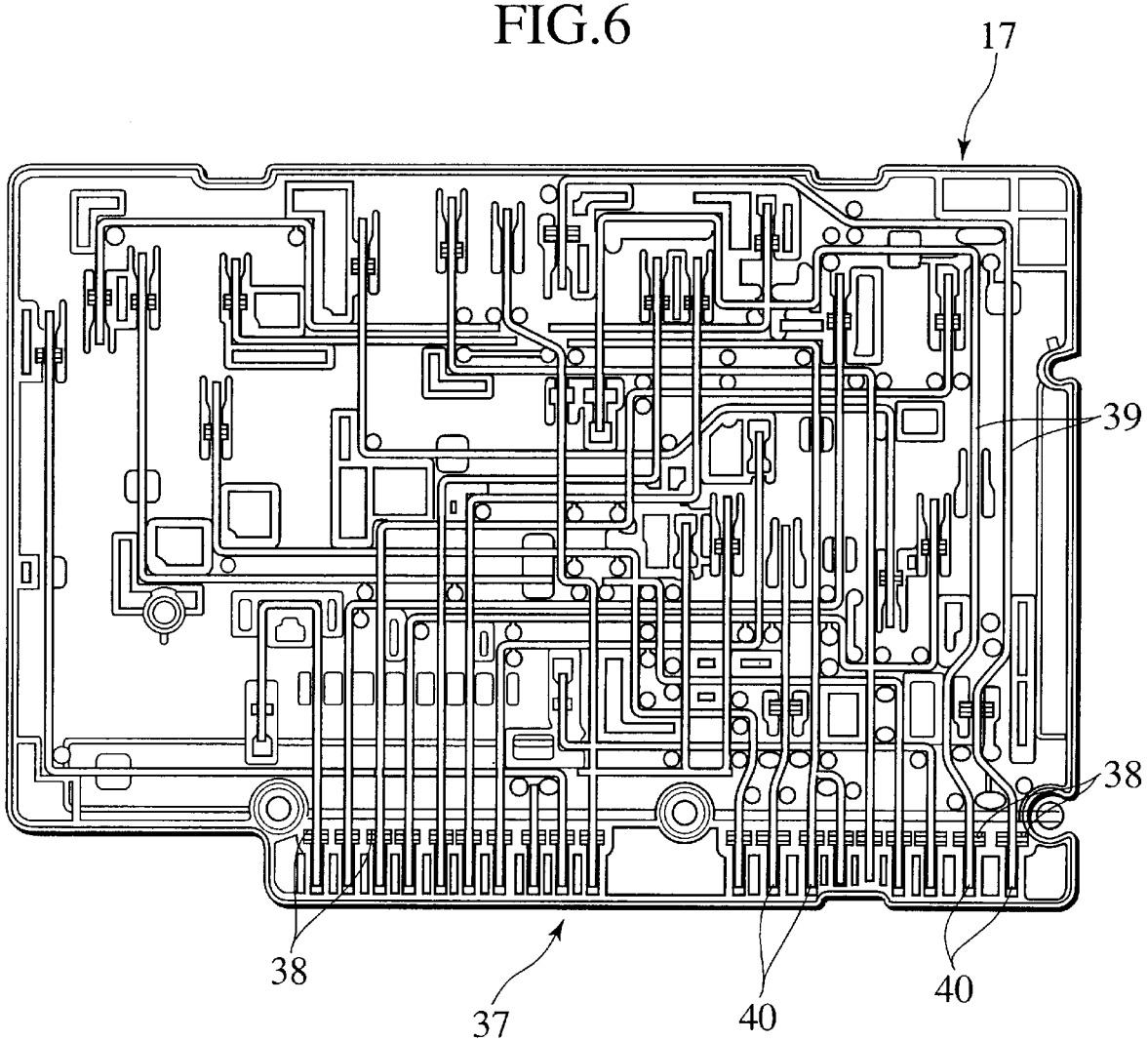
FIG. 6 is a plan view showing a rear face of the wiring plate, i.e. a face opposite to a face on which the wiring board is loaded, which illustrates electric wires cabled on the wiring plate.

As shown in FIG. 3, the wiring plate 17 is a rectangular hard-resin plate which appears similar to an inverted dish. Numerous pressure terminal insertion apertures 36 are formed on an upper face of the wiring plate 17, and a substrate fixture base 37 is provided on one side thereof. A plurality of pressure terminal insertion apertures 38 are also formed in a line along a side of the substrate fixture base 37. Moreover, as shown in FIG. 5 and FIG. 6, a plurality of cabling paths for cabling electric wires 39 (as conducting members) are formed on a rear face of the wiring plate 17. Circuits are constituted by cabling in accordance with the cabling paths. Terminal portions 40 of the cabled electric wires 39 are cabled on a rear face of the substrate fixture base 37 and positioned corresponding to the respective pressure terminal insertion apertures 38. As shown in FIG. 5, the wiring plate 17 is housed inside the under cover 15 and the wiring boards 18*a*, 18*b* and 18*c* are stacked on an upper side of the wiring plate 17.

Wiring Boards 18

As shown in FIG. 3, in the wiring boards (18*a*, 18*b* and 18*c*) 18, given circuits are severally configured on insulating plates 41 with bus bars 42, and numerous terminal portions 43 continuous to the respective circuits are erected. The terminal portions 43 on the low-stage wiring board 18*a* penetrate the wiring boards 18*b* and 18*c* thereabove and extend out to an upper face of the high-stage wiring board 18*c*; meanwhile, the terminal portions 43 of the middle-stage wiring board 18*b* penetrate and extend from the high-stage wiring board 18*c*. Thereafter, the wiring boards 18*a*, 18*b* and 18*c* are mutually superimposed. In this event, a pressure terminal portion 25 in FIG. 5, which is bent downward and provided on the bus bar 42 of the wiring board 18*a* of the lowest stage, penetrates the wiring plate 17 and is connected, by solderless connection to the electric wire 39 cabled on the rear face of the wiring plate 17. Meanwhile, the control board 19 is fixed on the wiring plate 17 together with the wiring boards 18 stacked in multiple stages.

Control Board 19

Figure 7:
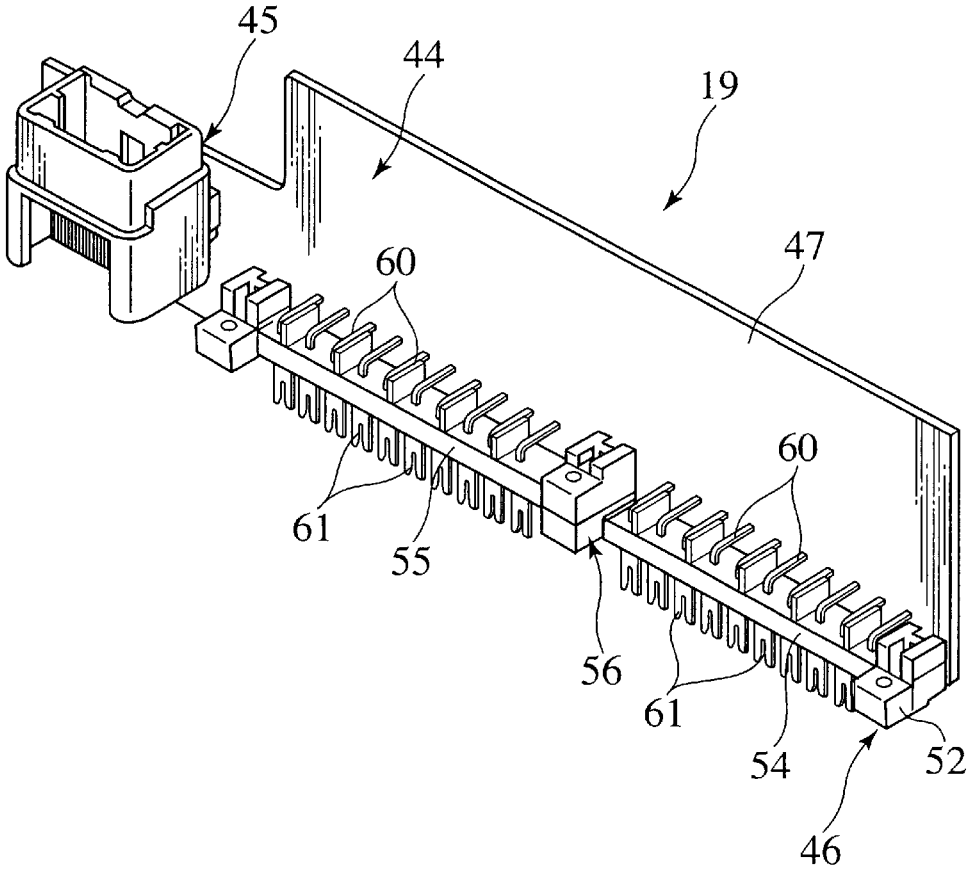
FIG. 7 is a perspective view showing a control board, which illustrates a terminal block and lead terminals.
Figure 8:
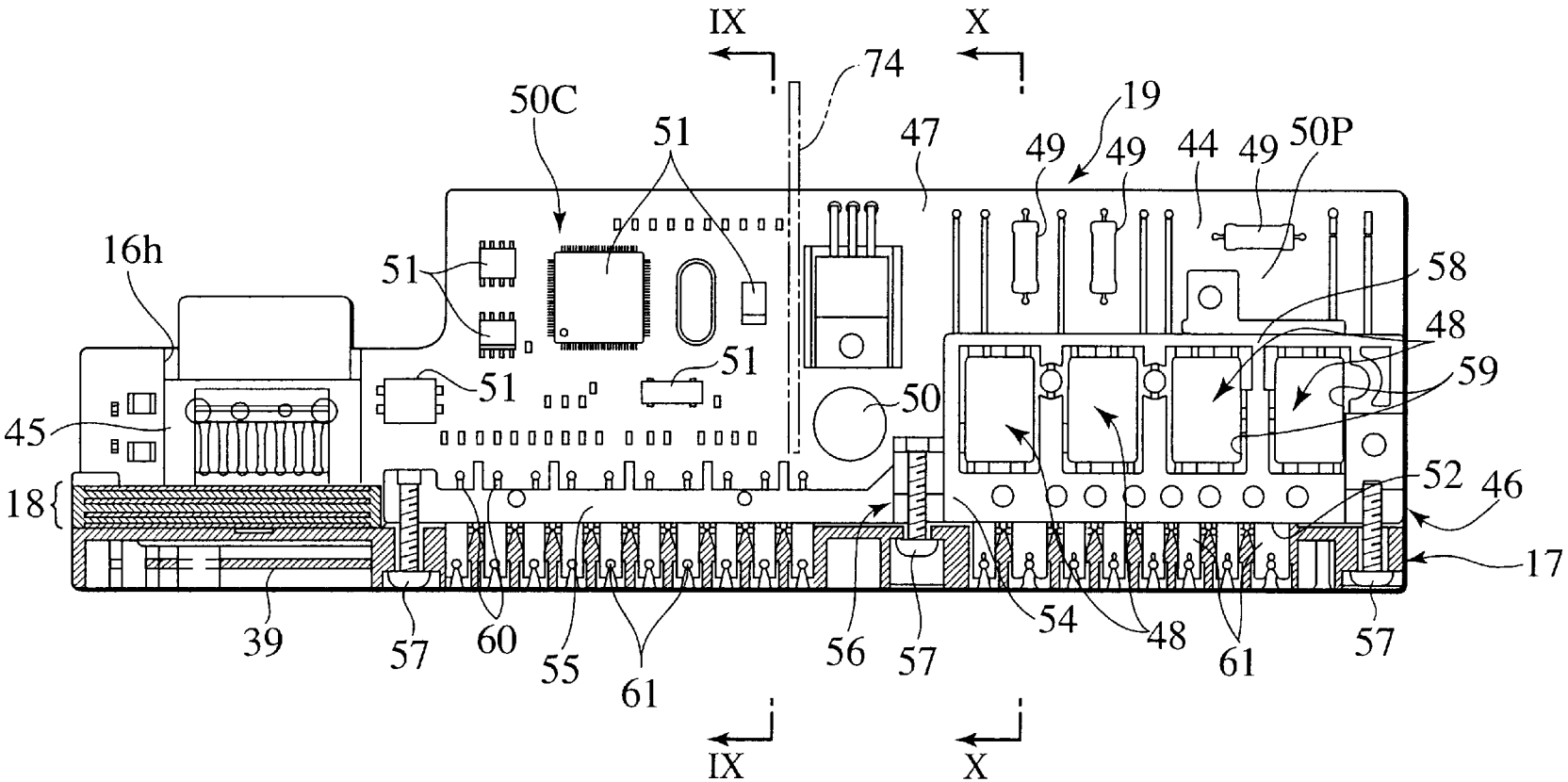
FIG. 8 is a front view showing the control board.
Figure 9:
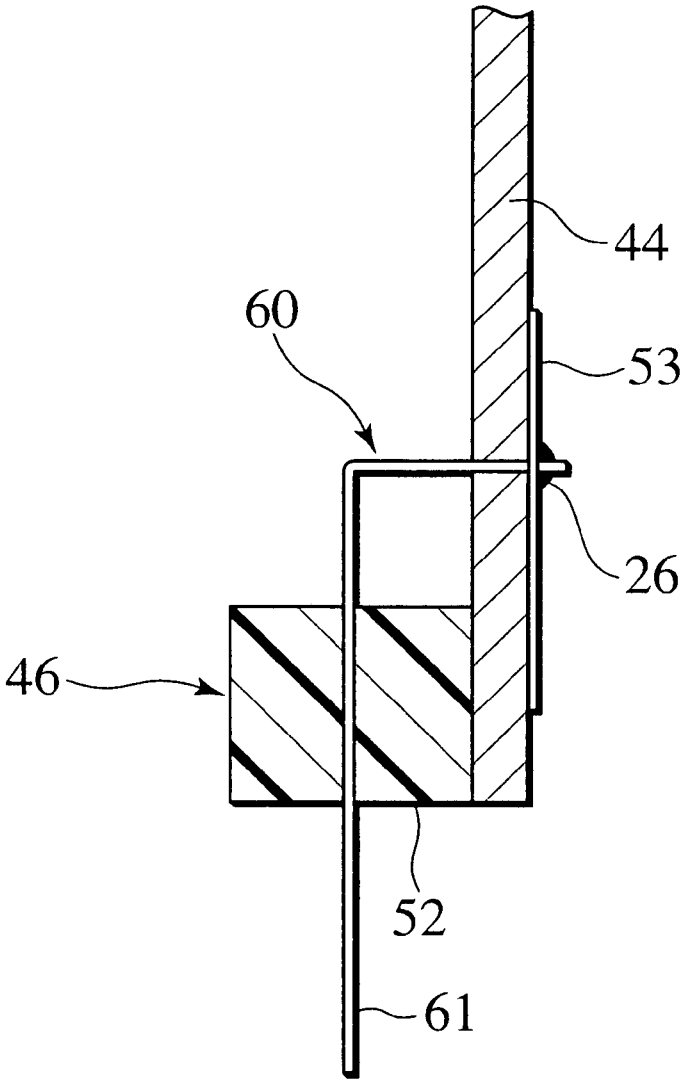
FIG. 9 is across-sectional view showing a relation between the substrate and the terminal block of the control board, which is taken along the IX—IX line in FIG. 8.

As shown in FIG. 7 and FIG. 8, the control board 19 includes a substrate 44, a substrate connector 45 fixed to the substrate 44, and a terminal block 46 for fixing the substrate 44 onto the wiring plate 17. On the substrate 44, various electronic components such as relays 48, resistors 49, a coil 50 and elements 51 constituting a control circuit are fitted on an insulating plate 47, and the substrate connector 45 is provided on an end portion in the longitudinal direction of the insulating plate 47. The substrate 44 is disposed on the wiring plate 17 in an upright state. Thus, the control board 19 is loaded substantially perpendicular to the wiring plate 17 in this embodiment. As shown in FIG. 9, the terminal block 46 is fitted on a bottom end of the front side of the substrate (the near side in FIG. 7) almost perpendicularly with respect to a plane thereof.

The relays 48, the resistors 49 and the coil 50 which are fitted on the substrate 44 collectively constitute a power unit 50P, and the elements 51 constitute a control unit 50C. As shown in FIG. 8, the power unit 50P of large heat generation is combined and disposed on one side in the longitudinal direction of the insulating plate 47, and the control unit 50C of small heat generation is combined and disposed on the other side in the longitudinal direction of the insulating plate 47.

Then, the relays 48, the resistors 49 and the coil 50 constituting the power unit 50P of large heat generation and the elements 51 constituting the control unit 50C of small heat generation are connected by a thin circuit pattern 53 (see FIG. 9). As it is generally known, the circuit pattern 53 is formed by printing a conductive material on the insulating plate 47, and the sectional area of the circuit pattern 53 depends on the width of printing. The substrate 44 is fixed to the substrate fixture base 37 of the wiring plate 17 by use of the terminal block 46.

Terminal Block 46

As shown in FIG. 7 and FIG. 8, the terminal block 46 is composed of a first divided block 54 and a second divided block 55 which are bisected approximately in the center portion in the longitudinal direction of the terminal block 46. As shown in FIG. 7, mutually abutting end portions of the first and second divided blocks 54 and 55 are superimposed on each other, thus constituting a superimposed portion 56. Moreover, as shown in FIG. 8, both end portions of the terminal block 46 and the superimposed portion 56 are fixed by fastening to the wiring plate 17 with screws 57 as fasteners to be inserted from the rear face of the wiring plate 17. In this event, the superimposed portion 56 is fastened integrally with one screw 57.

Figure 10:
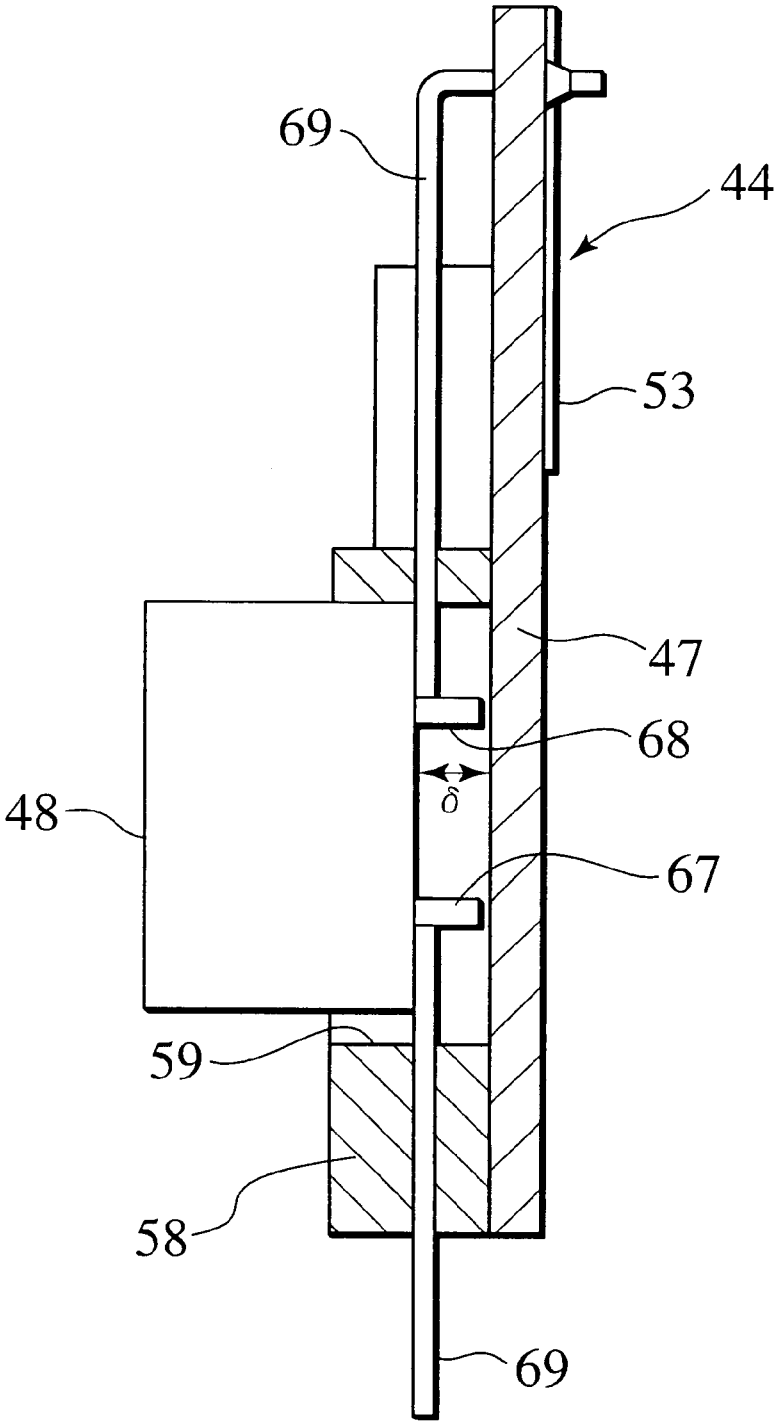
FIG. 10 is a cross-sectional view showing a relation between the substrate and a relay of the control board, which is taken along the X—X line in FIG. 8.

As shown in FIG. 10, a relay holder 58 is provided on a perpendicular inner face of the first divided block 54 as parallel to the insulating plate 47 of the substrate 44. Windows 59 are formed on the relay holder 58 at positions of the relays 48, and the relays 48 are fitted and held in the windows 59, thus stably holding the relays 48 which are fitted to the insulating plate 47 with spaces.

As shown in FIG. 9, a plurality of lead terminals 60 are integrally buried in the terminal block 46. A pressure terminal portion 61 is formed on one side of each lead terminal 60, and the other side thereof is bent in an L-shape toward the substrate 44 (i.e. the lead terminal 60 includes a bent portion exposed between the terminal block 46 and the substrate 44). A tip of the lead terminal 60 penetrates the substrate 44 and is soldered to the circuit 53 of the substrate 44. When the terminal block 46 is fixed to the substrate fixture base 37 of the wiring plate 17, the pressure terminal portion 61 of the lead terminal 60 is inserted from the solderless connection aperture 38 formed on the wiring plate 17 into the wiring plate 17, and the pressure terminal portion 61 is severally connected to a terminal of the electric wire 39 by solderless connection. In this way, in the state of fixing the terminal block 46 to the wiring plate 17, the terminal block 46 is located almost perpendicularly to the insulating plate 47 of the substrate 44. Accordingly, the substrate 44 is loaded perpendicularly on the wiring plate 17. In this event, the one side of the lead terminal 60 including the pressure terminal portion 61 extends out of a face of the terminal block orthogonal to the face of the substrate 44 in a direction parallel to the face of the substrate 44. The substrate connector 45 is fixed to one side of the substrate 44.

Substrate Connector 45

Figure 11:
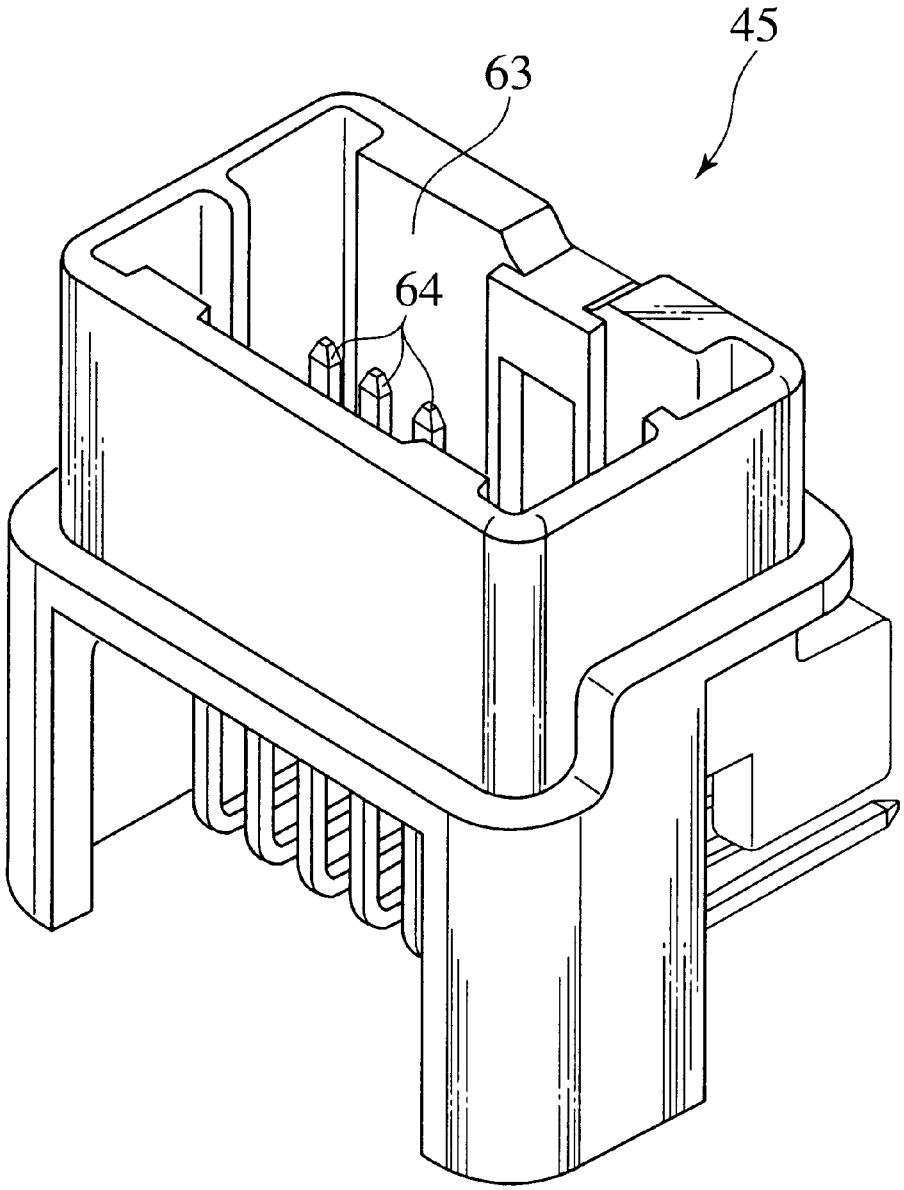
FIG. 11 is a perspective view showing a substrate connector.

As shown in FIGS. 7 and 11, the substrate connector 45 is provided independently of the substrate 44. The substrate connector 45 is designed to allow an opponent connector (not shown) to be inserted into a slot 63 formed thereon. End portions of a plurality of terminals 64 to be connected to the opponent connector extend out within the slot 63. The other ends of the terminals 64 extend outward (downward according to the drawing) from the slot 63, and respective tips thereof are bent orderly toward a direction perpendicular to the substrate 44.

Figure 12:
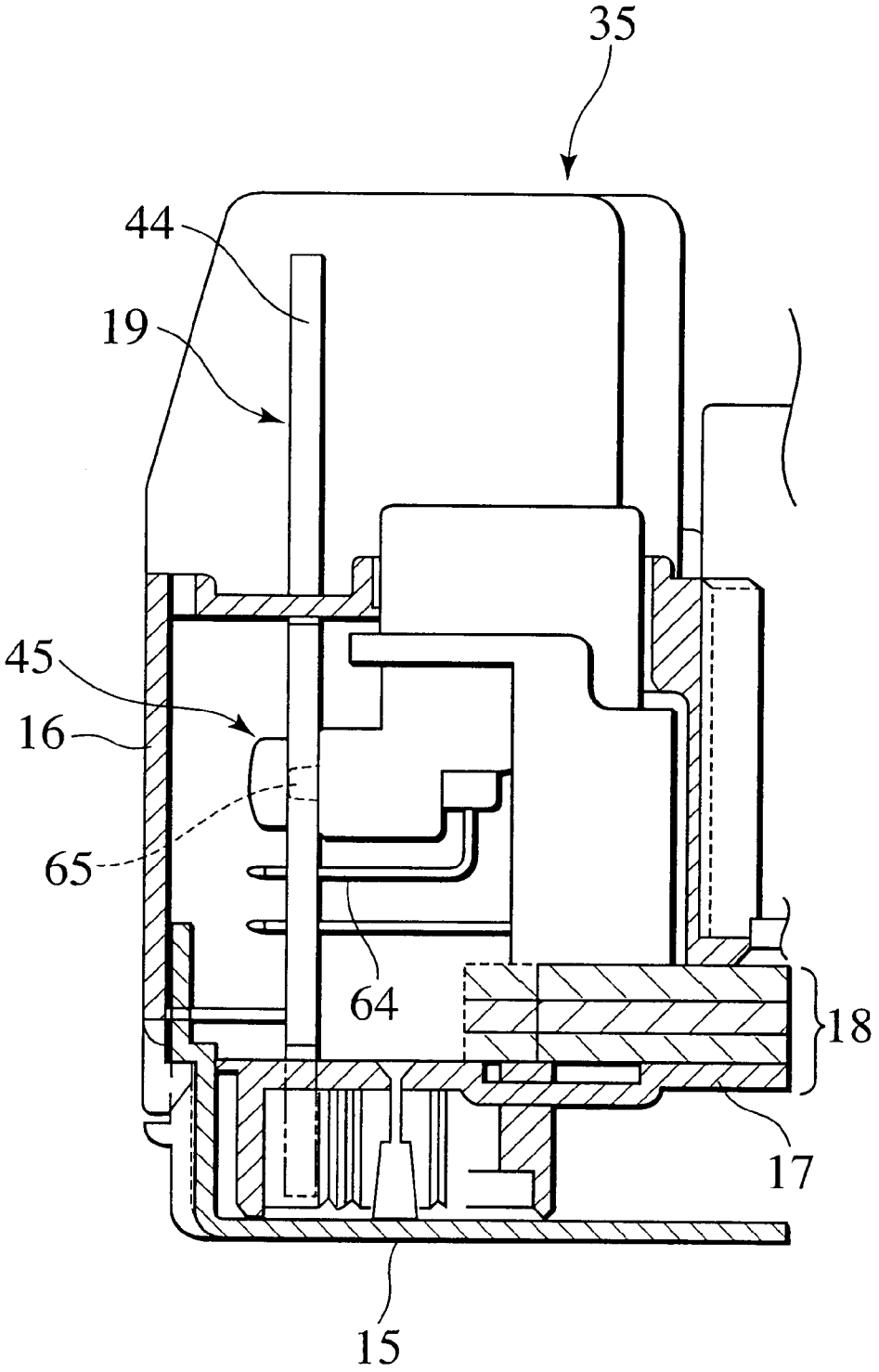
FIG. 12 is a cross-sectional view showing a relation between the substrate connector inside an expanded portion and the wiring plate, which is taken along the XII—XII line in FIG. 2.

Moreover, as shown in FIG. 12, the substrate connector 45 allows a protrusion 65 provided on a back side thereof to be fitted by pressure into a fitting hole (not shown) formed on the insulating plate 47 of the substrate 44 and inserts the tips of the terminals 64 into the substrate 44 to connect the tips to the given circuit pattern 53. In this event, an open portion of the slot 63 of the substrate connector 45 faces outward from an aperture 16*h* formed on the upper cover 16.

Relay 48

Meanwhile, the relay 48 adopts a mechanism using electromagnetic solenoid and includes a structure for on-and-off switching with this electromagnetic solenoid, and thus heat generation by the electromagnetic solenoid is significant. Accordingly, as shown in FIG. 10, the relay 48 is designed to be fitted to the insulating plate 47 of the substrate 44 with provision of a given space δ while the relay 48 is supported by the relay holder 58.

Moreover, power terminals 67 and 68 of the relay 48 thus fitted with the space are severally connected to lead terminals 69. Here, at least one of the lead terminals 69 once extends long parallel to the insulating plate 47 and protrudes out in a space from the relay 48 until reaching the insulating plate 47. Meanwhile, a tip of the portion thus exposed by the protrusion is bent toward the insulating plate 47 and soldered to the circuit pattern 53. In this case, the exposed lead terminal 69 possesses a heat releasing function.

The control board 19 fixed onto the wiring plate 17 is housed inside the expanded portion 35 of the upper cover 16 in the state of assembly of the terminal block 46 and the substrate connector 45 on the substrate 44.

Expanded Portion 35 of Upper Cover 16

As shown in FIG. 2 and FIG. 3, on one side edge (far sides in FIGS. 1 and 2) of the socket stage 24 of the upper cover 16 on the side where the control board 19 is disposed, formed is the expanded portion 35 having a protruding amount h greater than protrusions by the various external relays 20, 21 and 22, and the fuses 23, which are fitted on the relay sockets 16*b*, 16*c* and 16*d*, and the fuse socket 16*e*. Meanwhile, as shown in FIG. 5, the substrate 44 is to be housed inside the expanded portion 35.

As shown in FIG. 2 and FIG. 5, the expanded portion 35 is formed into a horseshoe cross section by a heat shield wall 70 for shielding the substrate 44 from the relay sockets 16*b*, 16*c* and 16*c* of the upper cover 16, a ceiling wall 71 continuing from the heat shield wall 70, and a back face wall 72 covering the rear side of the substrate 44. As shown in FIG. 2, both sides of the expanded portion 35 are closed by side walls 73.

Moreover, as shown in FIG. 8, the power unit 50P of large heat generation such as the relays 48, the resistors 49 and the coil 50, and the control unit 50C of small heat generation such as the elements 51 constituting the control circuit are separately disposed on the substrate 44. Here, as shown in FIG. 8, provided inside the expanded portion 35 is a heat-shielding partition wall 74 to be inserted between the power unit 50C and the control unit 50C for shielding between the power unit 50P and the control unit 50C. Note that the heat-shielding partition wall 74 is illustrated with a chain double-dashed line in FIG. 8.

Therefore, in the state where the substrate 44 is housed between the upper cover 16 and the under cover 15, the expanded portion 35 covers the outside of the control board 19; meanwhile, the heat-shielding partition wall 74 is inserted into an interface portion of the substrate 44 between the portion of large heat generation and the portion of small heat generation. The junction box body 14 thus constituted is mounted on a vehicle in the state of being housed inside the casing 11 composed of the upper case 13 and the lower case 12 as previously described.

Casing 11

As shown in FIG. 1, regarding the casing 11, a sidewall 13*a* of the upper case 13 is fitted into an outer periphery of a sidewall 12*a* of the lower case 12. Here, a lock claw 13*b* on the side of the upper case 13 is designed to be detachably engaged with a locking projection 12*b* of the lower case 12.

On the upper case 13 and the lower case 12, openings 13*c* and 12*c* are formed by severally cutting away portions corresponding to the connector slots 16*f* integrally provided on the upper cover 16 of the junction box body 14 and to the substrate connector 45. The openings 13*c* and 12*c* collectively constitute one opening portion when the upper case 13 and the lower case 12 are mutually fitted together.

Between the openings 13*c* and 12*c*, provided is a closing member 81 independently of the upper case 13 and the lower case 12. The closing member 81 closes up a gap between the openings 13*c* and 12*c* upon fitting the upper case 13 and the lower case 12. A lock claw 81*a* of the closing member 81 is detachably fixed to a locking projection 12*d* of the lower case 12.

In this event, a bottom-half semicylindrical portion 12*e* formed on the bottom of the opening 12*c* and a top-half semicylindrical portion 81*b* formed on the bottom of the closing member 81 coalesce into a tube, whereby the tube permits passage of integrated wire harnesses for opponent connectors (not shown) to be joined to the connector slots 16*f* and the substrate connector 45. Moreover, a fitting leg 12*f* is provided perpendicularly to the lower case 12, which serves as a fixture to the vehicle.

Upon housing the junction box body 14 in the casing 11, as shown in FIG. 1, the junction box body 14 is first housed in the lower case 12 in such a manner that the expanded portion 35 is disposed upward, and then the upper case 13 is fitted into the outer periphery of the lower case 12, and the lock claw 13*b* and the locking projection 12*b* are engaged together. Then, after joining the opponent connectors to the connector slots 16*f* and the substrate connector 45 of the junction box body 14 by inserting the opponent connectors from the opening portion, the closing member 81 is disposed on the opening portion and the lock claw 81*a* is engaged with the locking projection 12*d* while cabling the wire harnesses between the top-half and bottom-half semicylindrical portions 81*b* and 12*e*.

Meanwhile, upon housing the junction box body 14 in the casing 11 by insertion from above, the first guide hooks 16*g* and 15*c* on the both sidewalls 16*a* and 15*a* stretching in the X direction (see FIG. 2) of the junction box body 14 are engaged with locking portions (not shown) provided on an inner side of the lower case 12. At the same time, tip faces of the first guide hooks 16*g* and 15*c* abut elastically on the inner side of the lower case 12, thus preventing the junction box body 14 from jolting inside the casing 11.

In addition, upon housing the junction box body 14 in the casing 11, the socket stage 24 of the upper cover 16 is disposed on a side of a front face 12*g* of the lower case 12. In this event, the fuse socket 16*e* on the socket stage 24 is located at an upper-end right-half portion (as illustrated with a chain double-dashed line in the drawing) of the front face 12*g* of the lower case 12. In the embodiment, the upper-end right-half portion is cut away in advance to form an opening 12*h* where the fuse socket 16*e* is exposed.

Operation

According to the above-described constitution, in the junction box 10 of the embodiment, the junction box body 14 is constituted by loading the control board 19 to be the control unit on the wiring plate 17 and by housing the foregoing object between the upper cover 16 and the under cover 15. Accordingly, the junction box 10 is constituted by housing the junction box body 14 in the casing which is composed of the upper case 13 and the lower case 12. Regarding the junction box 10, the lower case 12 thereof is fitted inside an engine room of an vehicle (not shown) via the fitting leg 12*f*, and wire harnesses (not shown) for various electrical components to be installed on the vehicle are connected intensively thereto.

According to the junction box 10, when the control board 19 is mounted on the wiring plate 17, the solderless connection portions 61 of the terminal block 46 fitted on the insulating plate 47 are inserted into the solderless connection apertures 38 of the wiring plate 17 and the terminal block 46 is fixed by fastening to the wiring plate 17 with the screw 57. In this event, the terminal block 46 is fitted almost perpendicularly with respect to the plane of the insulating plate 47 and a perpendicular outer face 52 thereof abuts on a surface of the wiring plate 17. Accordingly, when viewed as a whole, the substrate 44 is mounted perpendicularly on the wiring plate 17.

Therefore, an area equivalent to the perpendicular outer face 52 of the terminal block 46 is sufficient for a loading space on the wiring plate 17 for the substrate 44. Accordingly, it is possible to reduce the area required for the wiring plate 17 and to curtail a bus bar for connecting the wiring plate 17 and the substrate 44, which has been conventionally required in the case of loading the substrate flatways. As described, reduction of the area on the wiring plate 17 effectuates downsizing of the junction box body 14, and eventually effectuates compact formation of the junction box 10. As a result, a layout can be facilitated when the junction box 10 is disposed in a restricted space in the engine room. Of course, a place to dispose the junction box 10 is not always limited to the engine room, but other free spaces of the vehicle such as a space below a dashboard or a trunk can be also selected.

Moreover, when the terminal block 46 is fixed by bonding to the wiring plate 17, the pressure terminal portions 61 are directly connected, by solderless connection, to the electric wires 39 cabled on the rear face of the wiring plate 17, by means of inserting the pressure terminal portions 61 into the solderless connection apertures 38 of the wiring plate 17. In this way, intermediate terminals and connectors are not required upon connection of the respective pressure terminal portions 61, whereby substantial reduction in the number of the components is achieved and assembling efficiency of the substrate 44 is enhanced.

Furthermore, the terminal block 46 is divided into pluralities in the longitudinal direction thereof and the terminal block 46 is thereby composed of the first and second divided blocks 54 and 55, and the superimposed portion 56 is fastened integrally with the screw 57 when the first and second divided blocks 54 and 55 are severally fixed by fastening to the wiring plate 17 via the screw 57. In this way, it is possible to reduce the number of the screws 57 in comparison with the case of severally fixing both end portions of the first and second divided blocks 54 and 55, and the number of steps upon assembly can be thereby curtailed. Moreover, since the adjacent first and second divided blocks 54 and 55 can be integrated together with the common screw 57, overall fitting accuracy of the terminal block 46 can be enhanced.

In addition, according to the embodiment, connection between the pressure terminal portions 61 extending out of the perpendicular outer face 52 of the terminal block 46 and desired circuits on the substrate 44 is achieved via the lead terminals 60. Here, each of the lead terminals 60 is bent perpendicularly in the position between the pressure terminal portion 61 and the insulating plate 47 of the substrate 44. Simultaneously, the other end of the lead terminal 60 penetrates the insulating plate 47 to the rear side thereof and is soldered. Accordingly, upon connecting the pressure terminal portions 61 to the electric wires 39 by solderless connection, load generated by the solderless connection is prevented to be directly inputted to a soldered portion 26 owing to flexure of the perpendicularly-bent lead terminals 60. Therefore, the present invention can prevent occurrence of cracks at the soldered portion 26 by solderless connection force applied by the pressure terminal portions 61, prevent extraction of the lead terminals 60 therefrom, and prevent defective electric connection eventually.

Although only one embodiment of the invention have been disclosed and described, it is apparent that the other embodiments and modification of the invention are possible.

What is claimed is:

1. A junction box comprising:

a casing; and a junction box body housed in the casing, wherein the junction box body comprises a first board having a conducting member to form a circuit thereon;

second and third boards mounted on the first board, respectively including a circuit formed thereon to be connected to the circuit of the first board; and a cover for housing the first, second and third boards, wherein the third board includes a substrate;

a terminal block fitted on the substrate; and a conductor connected to the circuit of the third board, and provided with a pressure terminal extending out of the terminal block, the pressure terminal for penetrating through the first board to be connected by solderless connection to the conducting member of the first board.

2. The junction box according to claim 1, wherein the substrate of the third board is mounted substantially perpendicular to the first board.

3. The junction box according to claim 1, wherein the conducting member of the first board is arranged to form the circuit on a face opposite to a face thereof on which the second board is mounted.

4. The junction box according to claim 1, wherein the second board includes a bus bar to form the circuit thereof, and the bus bar is provided with a pressure terminal for penetrating through the first board to be connected by solderless connection to the conducting member of the first board.

5. The junction box according to claim 1, wherein the terminal block of the third board is divided in a longitudinal direction thereof into divided blocks, and adjacent end portions of the respective divided blocks are mutually superimposed to be fastened integrally to the first board.

6. The junction box according to claim 1, wherein the terminal block is configured with a face perpendicular to the substrate, and the pressure terminal of the conductor extends out of the face in a direction parallel to the substrate.

7. The junction box according to claim 6, wherein the conductor penetrates the terminal block and the substrate, and has a bent portion exposed in a position between the terminal block and the substrate.

8. The junction box according to claim 7, wherein an end portion of the conductor penetrating the substrate is soldered to the circuit of the third board.

9. The junction box according to claim 1, wherein the third board further includes:

a relay to be connected to the circuit of the third board; and a relay holder for holding the relay, and securing a predetermined space from the substrate.

10. The junction box according to claim 9, wherein a wire for connecting the relay to the circuit of the third board includes an exposed portion extending substantially parallel to the substrate.

11. A junction box comprising:

a casing; and a junction box body housed in the casing, wherein the junction box body comprises a first board having a conducting member to form a circuit thereon;

a plurality of second boards stacked on the first board, respectively including a circuit formed thereon, at least one of the circuit to be connected to the circuit of the first board, a third board mounted on the first board, including a circuit formed thereon to be connected to the circuit of the first board; and a cover for housing the first, second and third boards, wherein the third board includes a substrate;

a terminal block fitted on the substrate; and a conductor connected to the circuit of the third board, and provided with a pressure terminal extending out of the terminal block, the pressure terminal for penetrating through the first board to be connected by solderless connection to the conducting member of the first board.

* * * * *

UNITED STATES PATENT AND TRADEMARK OFFICE

CERTIFICATE OF CORRECTION

PATENT NO. : 6,602,079 B2
DATED : August 5, 2003
INVENTOR(S) : Akihiko Chiriku et al.

It is certified that error appears in the above-identified patent and that said Letters Patent is hereby corrected as shown below:

Column 10,
Line 37, "board," should read -- board; --.

Signed and Sealed this

Ninth Day of December, 2003

JAMES E. ROGAN
*Director of the United States Patent and Trademark Office*